United States Patent [19]

Rapseik

[11] 4,397,067

[45] Aug. 9, 1983

[54] SAFETY EARNUT

[75] Inventor: Christopher S. Rapseik, Patterson, N.Y.

[73] Assignee: Avon Products, Inc., New York, N.Y.

[21] Appl. No.: 274,320

[22] Filed: Jun. 16, 1981

[51] Int. Cl.[3] ..... A44C 7/00

[52] U.S. Cl. ..... 24/108; 24/155 BB; 63/12; 411/520

[58] Field of Search ..... 63/12, 13; 411/520, 411/516, 522, 521; 24/216, 217 R, 108, 155 BB, 289

[56] References Cited

U.S. PATENT DOCUMENTS

| | | | |
|---|---|---|---|
| 183,164 | 10/1876 | Hessels | 24/155 BB |
| 276,993 | 5/1883 | Arnold | 63/12 |
| 320,991 | 6/1885 | Westcott | 63/12 UX |
| 426,999 | 4/1890 | Lewis | 24/108 |
| 822,011 | 5/1906 | O'Donnell | 63/12 UX |
| 999,171 | 7/1911 | Leu | 24/155 BB |
| 1,016,943 | 2/1912 | Hoops | 24/155 BB |
| 1,238,357 | 8/1917 | Stoner | 24/155 BB |
| 2,271,899 | 2/1942 | Miller | 24/217 |
| 2,283,125 | 5/1942 | Powell | 411/522 |
| 2,288,710 | 7/1942 | Hotchkin | 411/520 |
| 2,339,664 | 1/1944 | Tinnerman | 411/521 |
| 2,667,675 | 2/1954 | Brutti | 24/155 BB |
| 2,691,846 | 10/1954 | Fruling | 63/12 |

FOREIGN PATENT DOCUMENTS

| | | | |
|---|---|---|---|
| 47888 | 7/1889 | Fed. Rep. of Germany | 63/12 |
| 1117966 | 6/1978 | United Kingdom | 63/12 |

*Primary Examiner*—F. Barry Shay

[57] ABSTRACT

An earnut for use in securing earrings of the type worn on pierced ears is provided with a safety shield for preventing any earring post portion at the posterior side of the wearer's earlobe from coming into contact with the head and neck surfaces adjacent the earlobe to thereby prevent discomfiture or injury to the wearer.

4 Claims, 3 Drawing Figures

SAFETY EARNUT

BACKGROUND OF THE INVENTION

Earrings for use in pierced earlobes are provided with a post which is inserted by the user through the earlobe, the post generally being sized such that a portion of the post extends beyond the earlobe, the earring being secured at the earlobe posterior side with an earnut received on the post portion. Earnuts commonly used for this purpose have been of such size and design as to allow the tip end of the post portion to extend beyond the earnut. Further, the shapes of the earnuts can be such as to present relatively sharp surfaces so that if the earlobe is pressed against the user's adjacent neck or head surfaces as when sleeping and if the earrings are being worn, such sharp surfaces or a projecting post tip end can be brought into discomforting or injury producing contact with such neck or head surfaces. The potential for undesirable discomforting contact in this regard is increased with respect to younger children who are more likely to fail to remove their earrings when retiring or who as children are wont to do, engage in play activities heightening the possibility of such discomforting or injurious contact occurring.

SUMMARY OF THE PRESENT INVENTION

The present invention relates to an earnut for use with earrings of the type having a post which passes through the user's earlobe. The portion of the post extending beyond the posterior side of the earlobe is received in the earnut to thereby secure the earring on the earlobe. The present invention provides that the earnut is designed to prevent an earring post portion tip end from contacting the wearer's neck or head in the regions adjacent the earlobe to thereby protect same from discomforting or injurious contact. Moreover, the earnut itself is structured with a smooth contoured configuration to insure that it causes no undesirable result if pressed against the wearer's neck or head in the regions proximate the earlobe.

In accordance with the present invention the earnut comprises a housing including therein means which define a passage having entry thereto at one side of the housing, such passage serving to receive the extending portion of the earring post and hold or grip same with a flexibly yieldable embrace and thereby retain the earring securely in place on the earlobe. The passage defining means conveniently is provided in the form of a pair of confronting elongate fingers each having longitudinally extending grooves aligned with and facing a like groove in the other. The grooves thereby present a receptor space generally conformable in configuration with that of the earring post and sized in non-use configuration to be slightly smaller than the diameter of such post. Disposed in opposed relationship with the passage, i.e., at an opposite side of the housing, is a shield which is arranged generally transversely to the axis of the passage and which has a broad area relative to the expanse of the passage. The shield serves to protect the wearer's neck and head surfaces adjacent the earlobe from incursion thereupon by the tip end of the earring post as could occur with prior types of earnuts not having protective structure like such shield. The fingers are flexibly connected to the shield by means of connector tab pieces, there being two tab pieces, one each associated with a respective finger. Each tab piece includes a first portion connected to one end of the associated finger adjacent the point of entry to the passage and extends radially outwardly a distance from the passage to a point of merger with a second tab piece portion which in turn is connected to the shield, such second portion extending generally codirectional with the passage. Each connector tab piece thus presents a generally right angular profile and hence connects the associated finger with the shield in a flexible mounting so that the fingers are susceptible to movement away from and toward each other responsive to the respective entry and removal actions of the post portion in the passage.

Each finger groove can be provided with a protuberant dimple extending slightly into the passage to serve as a stop abutment to the post portion upon entry thereof into the passage. If the post portion is sufficiently long, the fingers will yield radially outwardly to provide continued travel of the post into the passage until the said one side of the housing snubs up closely against the posterior surface of the earlobe. However, the yieldable spread of the fingers will because of their flexible mounting produce a counter bias embrace on the post portion to improve the retentive grasp thereon. The dimple may also serve to enter as a holding detent means into a groove in the post portion if same is provided with such.

The shield member not only serves as a barrier to protect the wearer from the tip end of the earring post, but is itself of smooth broadened configuration to provide comfortable, non-injurious contact with the wearer's skin if the earlobe be pressed toward the head and neck. In a preferred embodiment, the shield is of partihollow spheroid configuration which in itself contributes to the attractiveness of the earnut as well as the facility with which it may be grasped by the user.

It is convenient to make the earnut from a single piece of metal stock so that the fingers, tab pieces and shield are of single piece unitary construction.

TABLE OF DRAWINGS

The invention will appear more clearly from the following detailed description taken in conjunction with the accompanying drawings in which.

Throughout the following description, like reference numerals are used to denote like parts in the drawings.

DESCRIPTION OF THE PREFERRED EMBODIMENTS

The present invention relates to an earnut for use with earrings of the type worn by users with pierced ears. The earnut embodies features which make it a safety device to protect the user from injury, discomfort or annoyance as could be caused by contact of the user's head or neck with the tip end portion of the earring post or of the earnut itself if it had sharp rough protuberant structure thereon. It is particularly advantageous for use by children wearing earrings of the pierced ear type. Additionally it is of smooth, clean configuration and is attractive in appearance.

Figure 1:
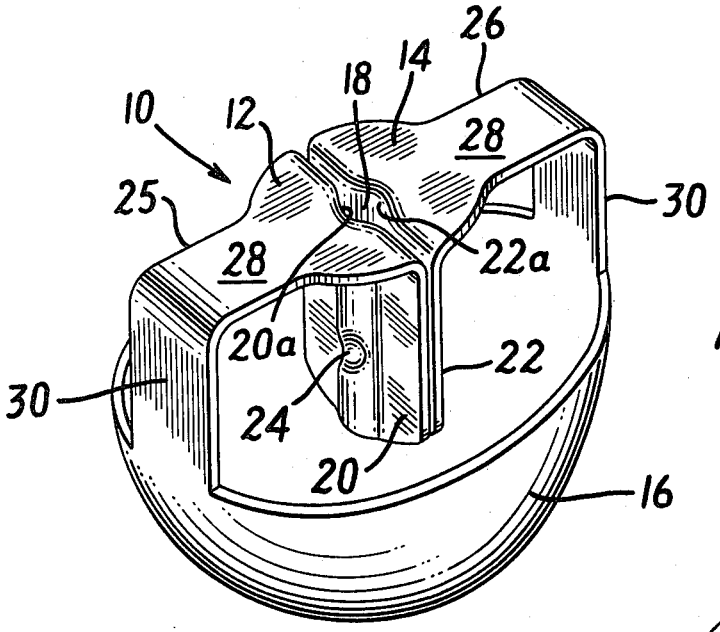
FIG. 1 is a perspective view of an earnut constructed in accordance with the principles of the present invention.
Figure 2:
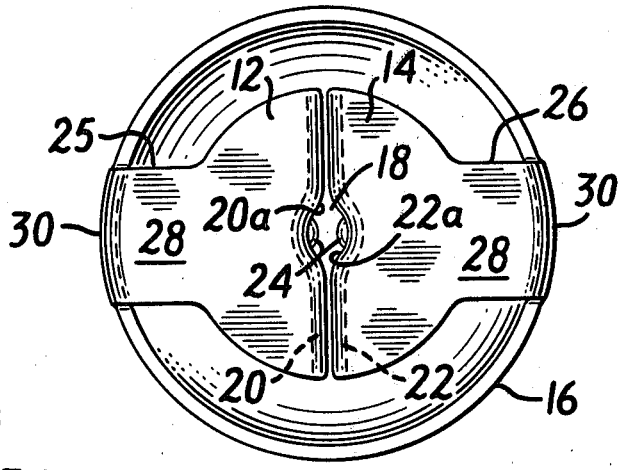
FIG. 2 is a top plan view of the earnut shown in FIG. 1.
Figure 3:
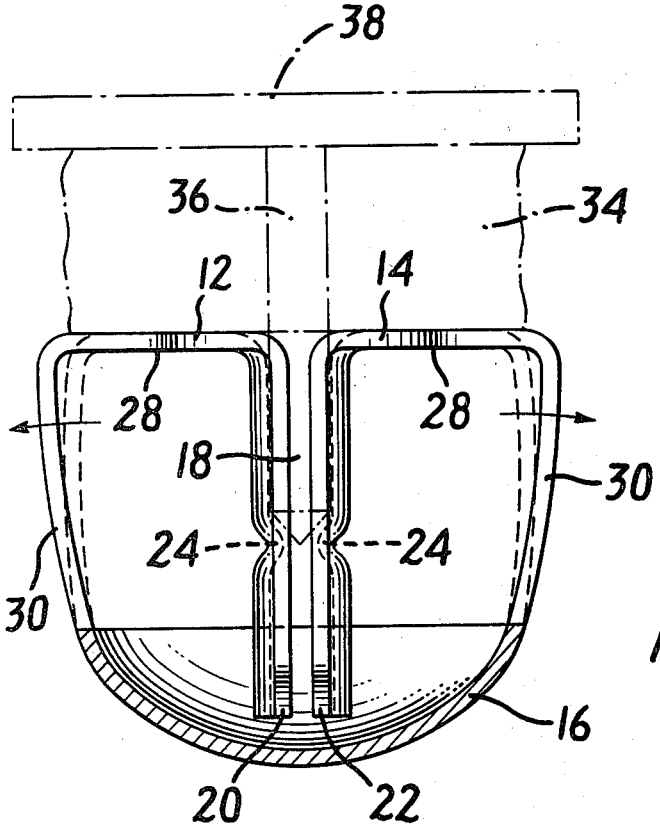
FIG. 3 is a front elevational view partly in section of the earnut shown in FIGS. 1 and 2, the fingers having been spread laterally to accommodate reception of the earring post.

Referring now to FIGS. 1–3, earnut 10 comprises a structure or housing having a first or post receiving side at which are disposed a pair of flat, generally semi-circular surfaces 12, 14 (to be described more in detail below) which nest abuttedly against the wearer's earlobe posterior in use, and a second opposite side defined by shield 16. The earnut serves to receive the portion of an earring post which extends beyond and behind the earlobe and thereby secure the earring to the ear. For reception of the post, the earnut 10 includes a passage 18 defined by a pair of confronting, closely adjacently disposed fingers 20, 22, the fingers extending from the first housing side a distance toward the shield 16. The fingers 20, 22 each are narrow but relatively wide and are provided with respective grooves 20*a*, 22*a* of generally concave cross-section and extending the full length of the fingers, the spacing between the grooves 20*a*, 22*a* generally being less than the diameter of earring posts, and the grooves having contours generally conformable with those of such posts. Each groove 20*a*, 22*a* is provided with a dimple 24 struck inwardly from the material of which the fingers are formed so as to present abutments within the passage 18 to function as stops to the post portion entering the earnut or as a detent means to enter into holding relationship with any groove or depression in the earring post if same is provided with such. If the length of the post portion extending beyond the earlobe posterior surface is of considerable length, the tip end thereof will strike the dimples 24 and spread the fingers outwardly to permit passage of the post portion further into the passage and until the housing snubs against the earlobe. Although the fingers 20, 22 spread outwardly slightly as shown in FIG. 3, such occurrence will not affect the retentive grip with which the fingers hold the post portion and in fact will enhance such grip by applying a counter bias gripping force to the post portion inasmuch as the fingers are flexibly mounted in the manner as will be described next.

The respective fingers 20, 22 are connected in flexible mounting with shield 16 by means of respective tab pieces 25, 26. Each tab piece includes as shown a first generally straight portion 28 extending laterally or radially from the passages 18 and second integral straight portion 30 disposed substantially right angularly with the first and extending codirectional with the fingers and passage 18 to a point of joinder with the shield 16. This cantilever mounting of the fingers allowing them to flex inwardly and outwardly of the passage and the shape of the tab pieces imparts an elastic character to the mounting producing a biasing effect to insure firm retentive gripping of the fingers.

The first portions 28 of the tab pieces are formed in the region of their merger with the associated fingers with the respective upstanding or outstanding parts 12, 14 of semi-circular plan profile and of generally flat smooth surface to allow for same to present comfortable close earlobe contacting parts. FIG. 3 depicts the manner in which the said parts 12, 14 are disposed at the posterior surface of the earlobe 34 through which post 36 connected to earring 38 passes.

It is convenient to make the earnut from a single piece of flat stock which can be shaped to provide an integral, unitary structure comprising fingers, connector tab pieces and shield.

While there is above disclosed but one embodiment of the earnut of the present invention, it will be apparent that various modifications can be made therein without departing from the scope of the inventive concept disclosed.

What is claimed is:

1. An earnut for use with earrings of the type having a post adapted to pass through the user's earlobe with a portion of the post extending a distance beyond the posterior surface of the earlobe when the earring is worn, said earnut comprising:

a housing including means defining a passage having entry thereto at one side of said housing for receiving said extending portion of said post and holding same with flexibly yieldable embrace, said housing further including a shield defining a housing side opposite said one side and remotely distant from the entry to said passage, said shield being disposed transversely to the axis of said passage, said passage defining means comprising a pair of confronting elongate fingers each having a longitudinally extending groove alignedly facing a like groove in the other, and connector means for connecting said fingers from positions adjacent the entry to said passage to said shield whereby said fingers can move away from and toward each other upon entry and removal, respectively, of said post portion from therebetween, said connector means comprising a tab piece having a first portion connected with its associated finger adjacent the entry to said passage and extending radially therefrom a distance, and a second integral portion extending codirectional with said passage and connected to said shield.

2. The earnut of claim 1 in which said fingers, tab piece and shield are a unitary, single piece structure, the first portion of the respective tab pieces having relatively widened axially outstanding, relatively flat face parts where said first portions merge with their associated fingers to thereby present comfortable close skin conforming structure abutting the earlobe posterior when mounted on said post portion.

3. The earnut of claim 1 in which said shield is of parti-hollow spheroid configuration, the convex surface of which faces away from said one side.

4. The earnut of claim 1 in which the grooves of said fingers carry dimples protruding into said passage to present abutments to said post portion upon entry thereof into said passage for causing said fingers to yieldably spread but thereby improve retentive counter bias embrace on said post portion.

* * * * *